US009805654B2

(12) United States Patent
Yang et al.

(10) Patent No.: US 9,805,654 B2
(45) Date of Patent: Oct. 31, 2017

(54) PIXEL CIRCUIT AND ITS DRIVING METHOD, ORGANIC LIGHT-EMITTING DISPLAY PANEL AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Shengji Yang, Beijing (CN); Xue Dong, Beijing (CN); Haisheng Wang, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 164 days.

(21) Appl. No.: 14/758,746

(22) PCT Filed: Sep. 30, 2014

(86) PCT No.: PCT/CN2014/087920
§ 371 (c)(1),
(2) Date: Jun. 30, 2015

(87) PCT Pub. No.: WO2015/180352
PCT Pub. Date: Dec. 3, 2015

(65) Prior Publication Data

US 2016/0275861 A1 Sep. 22, 2016

(30) Foreign Application Priority Data

May 29, 2014 (CN) ..... 2014 1 0234464

(51) Int. Cl.
*G09G 5/10* (2006.01)
*G09G 3/3258* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC .. G09G 3/3258; G09G 3/3233; G09G 3/3266; G09G 2320/043;
(Continued)

(56) References Cited

U.S. PATENT DOCUMENTS

2005/0200575 A1 9/2005 Kim et al.
2010/0141644 A1 6/2010 Lee et al.
(Continued)

FOREIGN PATENT DOCUMENTS

CN 101075410 A 11/2007
CN 101192374 A 6/2008
(Continued)

OTHER PUBLICATIONS

Second Chinese Office Action regarding Chinese Application No. 2014102344649 dated May 17, 2016. Translation provided by Dragon Intellectual Property Law Firm.
(Continued)

*Primary Examiner* — Adam R Giesy
*Assistant Examiner* — Chineyere Wills-Burns
(74) *Attorney, Agent, or Firm* — Harness, Dickey & Pierce, P.L.C.

(57) ABSTRACT

In the pixel circuit, at a charging stage, a charging unit controls a first end of a storage capacitor to be at a potential of an input signal from a second level signal input end, controls a second end of the storage capacitor to be at a
(Continued)

potential equal to a difference between a potential of an input signal from the first level signal input end and a threshold voltage of a driving TFT; at a compensation jumping stage, a compensation jumping unit controls the first end to be at a data voltage, and enable a voltage at the second end to jump to a sum of the data voltage and a difference between the potential of the input signal from the first level signal input end and the threshold voltage of the driving TFT, to enable a light-emitting unit to emit light using the data voltage.

19 Claims, 10 Drawing Sheets

(51) Int. Cl.
*G09G 3/3233* (2016.01)
*G09G 3/3266* (2016.01)

(52) U.S. Cl.
CPC ..... *G09G 2300/0426* (2013.01); *G09G 2300/0819* (2013.01); *G09G 2300/0861* (2013.01); *G09G 2310/0251* (2013.01); *G09G 2310/0262* (2013.01); *G09G 2310/061* (2013.01); *G09G 2320/0233* (2013.01); *G09G 2320/043* (2013.01); *G09G 2320/045* (2013.01); *G09G 2320/0626* (2013.01)

(58) Field of Classification Search
CPC ... G09G 2310/0262; G09G 2300/0861; G09G 2300/0819; G09G 2310/061; G09G 2320/0626; G09G 2320/0233; G09G 2310/0251; G09G 2300/0426
USPC ..... 345/690
See application file for complete search history.

(56) References Cited

U.S. PATENT DOCUMENTS

2015/0193045 A1* 7/2015 Zhou ..... G09G 3/3233 345/174
2016/0253011 A1* 9/2016 Yang ..... G06F 3/041 345/173

FOREIGN PATENT DOCUMENTS

| | | | |
|---|---|---|---|
| CN | 101266757 | A | 9/2008 |
| CN | 102411898 | A | 4/2012 |
| CN | 202339694 | U | 7/2012 |
| CN | 102708792 | A | 10/2012 |
| CN | 103236236 | A | 8/2013 |
| CN | 104021754 | A | 9/2014 |
| CN | 104036725 | A | 9/2014 |
| CN | 203858845 | U | 10/2014 |
| KR | 20070027265 | A | 3/2007 |
| KR | 20080067856 | A | 7/2008 |

OTHER PUBLICATIONS

First Office Action regarding Chinese application No. 201410234464.9, dated Sep. 25, 2015. Translation provided by Dragon Intellectual Property Law Firm.
Written Opinion of the International Searching Authority for international application No. PCT/CN2014/087920.

* cited by examiner

PIXEL CIRCUIT AND ITS DRIVING METHOD, ORGANIC LIGHT-EMITTING DISPLAY PANEL AND DISPLAY DEVICE

CROSS-REFERENCE TO RELATED APPLICATION

The present application is the U.S. national phase of PCT Application No. PCT/CN2014/087920 filed on Sep. 30, 2014, which claims a priority of the Chinese patent application No. 201410234464.9 filed on May 29, 2014, which is incorporated herein by reference in its entirety.

TECHNICAL FIELD

The present disclosure relates to the field of display technology, in particular to a pixel circuit and its driving method, an organic light-emitting display panel, and a display device.

BACKGROUND

Active matrix/organic light-emitting diode (AMOLED) display device is one of the research hotpots for a current flat-panel display device. Comparing with liquid crystal display devices, the OLED has such advantages as low power consumption, low production cost, self-luminescence, wide viewing angle and rapid response. Currently, OLED has begun to replace the typical LCD display panel in mobile phones, PDA, digital cameras and other display products. The design of a pixel driving circuit is a core of the AMOLED display device, and thus it is of important research significance.

Different from a TFT-LCD which controls the brightness with a stable voltage, the OLED is driven to emit light with a stable current. As shown in FIG. 1, an original 2T1C-based pixel circuit of the AMOLED display device consists of a driving thin film transistor (TFT), a switching TFT and a storage capacitor Cs. When a certain row of pixels is scanned by a scanning line, $V_{scan}$ is at a low level, the switching TFT T1 is turned on, and a data voltage $V_{data}$ is written into the storage capacitor Cs. When the scanning is ended, $V_{scan}$ is changed to be at a high level, T1 is turned off, and the driving TFT T2 is driven by a gate voltage stored in Cs so as to generate a current for driving the OLED, thereby to ensure the OLED to emit light continuously within one frame. A saturated current $I_{OLED}$ of the driving TFT may be calculated by the equation $I_{OLED}=K(V_{GS}-V_{th})^2$.

Due to a manufacturing process and the aging of elements, a threshold voltage ($V_{th}$) of the driving TFT for each pixel point will be drifted, which results in a change of the current passing through the OLED for each pixel point along with a change of the threshold voltage. As a result, the display brightness is uneven, and thereby a display effect of an entire image will be adversely affected.

SUMMARY

The present disclosure is provide a pixel circuit and its driving method, an OLED display panel, and a display device, so as to eliminate an effect caused by a threshold voltage of a driving TFT on a light-emitting driving signal, thereby to improve the brightness evenness of the OLED display panel as well as a display effect of the display device.

In one aspect, the present disclosure provides in one embodiment a pixel circuit, including a storage capacitor, a driving TFT and a light-emitting unit. A source electrode of the driving TFT is connected to a first level signal input end, a gate electrode of the driving TFT is connected to a second end of the storage capacitor, and a drain electrode of the driving TFT is connected to the light-emitting unit.

The pixel circuit further includes:

a charging unit configured to, at a charging stage, control a first end of the storage capacitor to be at a potential of an input signal from a second level signal input end, control the second end of the storage capacitor to be at a potential equal to a difference between a potential of an input signal from the first level signal input end and a threshold voltage of the driving TFT; and a compensation jumping unit configured to, at a compensation jumping stage subsequent to the charging stage, control the first end of the storage capacitor to be at a data voltage, and enable a voltage at the second end of the storage capacitor to jump to a sum of the data voltage and the difference between the potential of the input signal from the first level signal input end and the threshold voltage of the driving TFT, so as to, at a light-emitting stage subsequent to the compensation jumping stage, enable the light-emitting unit to emit light using the data voltage.

Alternatively, the charging unit is connected to the second level signal input end, a first scanning signal input end, the drain electrode of the driving TFT, and the first end and the second end of the storage capacitor.

Alternatively, the charging unit includes a first TFT and a second TFT. A source electrode of the first TFT is connected to the second level signal input end, a gate electrode thereof is connected to the first scanning signal input end, and a drain electrode thereof is connected to the first end of the storage capacitor. A source electrode of the second TFT is connected to the drain electrode of the driving TFT, a gate electrode thereof is connected to the first scanning signal input end, and a drain electrode thereof is connected to the second end of the storage capacitor.

Alternatively, the compensation jumping unit is connected to a data line, a second scanning signal input end and the first end of the storage capacitor.

Alternatively, the compensation jumping unit includes a third TFT, a source electrode of which is connected to the data line, a gate electrode of which is connected to the second scanning signal input end, and a drain electrode of which is connected to the first end of the storage capacitor.

Alternatively, the pixel circuit further includes a resetting unit configured to, at a resetting stage prior to the charging stage, control the second end of the storage capacitor to be at a potential of an input signal from the second level signal input end. The resetting unit is connected to the second level signal input end, a third scanning signal input end and the second end of the storage capacitor.

Alternatively, the resetting unit includes a fourth TFT, a source electrode of which is connected to the second level signal input end, a gate electrode of which is connected to the third scanning signal input end, and a drain electrode of which is connected to the second end of the storage capacitor.

Alternatively, the pixel circuit further includes a control unit configured to transmit, at the charging stage, the input signal from the first level signal input end to the driving TFT so that the input signal is transmitted to the charging unit via the driving TFT, and transmit, at the light-emitting stage, the input signal from the first level signal input end to the driving TFT so that the signal is transmitted to the light-emitting unit via the driving TFT. The control unit is connected to the first level signal input end, a control signal input end and the driving TFT.

Alternatively, the control unit includes a fifth TFT, a source electrode of which is connected to the first level signal input end, a gate electrode of which is connected to the control signal input end, and a drain electrode of which is connected to the source electrode of the driving TFT.

Alternatively, the light-emitting unit includes a sixth TFT, and an OLED. A source electrode of the sixth TFT is connected to the drain electrode of the driving TFT, a gate electrode thereof is connected to the second scanning signal input end, and a drain electrode thereof is connected to an anode of the OLED. A cathode of the OLED is connected to the second level signal input end.

Alternatively, the TFTs are P-type TFTs, the input signal from the first level signal input end is a high level signal, and the input signal from the second level signal input end is a low level signal.

In another aspect, the present disclosure provides in one embodiment a method for driving the above-mentioned pixel circuit, including steps of:

at a charging stage, controlling a first end of a storage capacitor to be at a potential of an input signal from a second level signal input end, and controlling a second end of the storage capacitor to be at a potential equal to a difference between a potential of an input signal from the first level signal input end and a threshold voltage of a driving TFT; and at a compensation jumping stage subsequent to the charging stage, controlling the first end of the storage capacitor to be at a data voltage, and enabling a voltage at the second end of the storage capacitor to jump to a sum of the data voltage and the difference between the potential of the input signal from the first level signal input end and the threshold voltage of the driving TFT, so as to, at a light-emitting stage subsequent to the compensation jumping stage, enable a light-emitting unit to emit light using the data voltage.

Alternatively, the method further includes, at a resetting stage prior to the charging stage, controlling the second end of the storage capacitor to be at the potential of the input signal from the second level signal input end.

Alternatively, at the charging stage, the method further includes transmitting the input signal from the first level signal input end to the driving TFT, so that the input signal is transmitted to the second end of the storage capacitor via the driving TFT, and at the light-emitting stage, the method further includes transmitting the input signal from the first level signal input end to the driving TFT, so that the input signal is transmitted to the light-emitting unit via the driving TFT.

Alternatively, at the resetting stage, a low level signal is inputted from a third scanning signal input end, a resetting unit is in an on stage, a high level signal is inputted from each of first and second scanning signal input end and a control signal input end, and a charging unit, a compensation jumping unit, the light-emitting unit and a control unit are in an off state.

At the charging stage, a low level signal is inputted from the control signal input end and the first scanning signal input end, the controlling unit and the charging unit are both in the on state, a high level signal is inputted from the second and third scanning signal input end, and the resetting unit, the compensation jumping unit and the light-emitting unit are in the off state.

At the compensation jumping stage, a low level signal is inputted from the second scanning signal input end, the compensation jumping unit and the light-emitting unit are in the on state, a high level signal is inputted from the first and third scanning signal input end and the control signal input end, and the resetting unit, the charging unit and the control unit are in the off state.

At the light-emitting stage, a low level signal is inputted from the second scanning signal input end and the control signal input end, the control unit, the compensation jumping unit and the light-emitting unit are in the on state, a high level signal is inputted from the first and third scanning signal input end, and the resetting unit and the charging unit are in the off state.

Alternatively, at the charging stage and the compensation jumping stage, a signal from a data line is at a negative voltage, and at the resetting stage and the light-emitting stage, the signal from the data line is at a positive voltage.

In yet another aspect, the present disclosure provides in one embodiment an OLED display panel including the above-mentioned pixel circuit.

In still yet another aspect, the present disclosure provides in one embodiment a display device including the above-mentioned OLED display panel.

According to the pixel circuit, its driving method, the OLED display panel and the display device in the embodiments of the present disclosure, the pixel circuit includes the charging unit configured to, at a charging stage, control the first end of the storage capacitor to be at the potential of the input signal from the second level signal input end, control the second end of the storage capacitor to be at the potential equal to a difference between the potential of the input signal from the first level signal input end and the threshold voltage of the driving TFT; and the compensation jumping unit configured to, at the compensation jumping stage subsequent to the charging stage, control the first end of the storage capacitor to be at the data voltage, and enable the voltage at the second end of the storage capacitor to jump to a sum of the data voltage and a difference between the potential of the input signal from the first level signal input end and the threshold voltage of the driving TFT, so as to, at the light-emitting stage subsequent to the compensation jumping stage, enable the light-emitting unit to emit light using the data voltage. As a result, it is able to eliminate an effect caused by the threshold voltage of the driving TFT on a light-emitting driving current, thereby to improve the display brightness evenness of the OLED display panel as well as an image display effect of the display device.

DETAILED DESCRIPTION

In order to make the objects, the technical solutions and the advantages of the present disclosure more apparent, the present disclosure will be described hereinafter in conjunction with the drawings and embodiments in a clear and complete manner. Obviously, the following embodiments merely relate to a part of, rather than all of, the embodiments of the present disclosure. Based on these embodiments, a person skilled in the art may obtain the other embodiments without any creative effort, which also fall within the scope of the present disclosure.

Unless otherwise defined, any technical or scientific term used herein shall have the common meaning understood by a person of ordinary skills Such words as "first" and "second" used in the specification and claims are merely used to differentiate different components rather than to represent any order, number or importance. Similarly, such words as "one" or "one of" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

Figure 1:
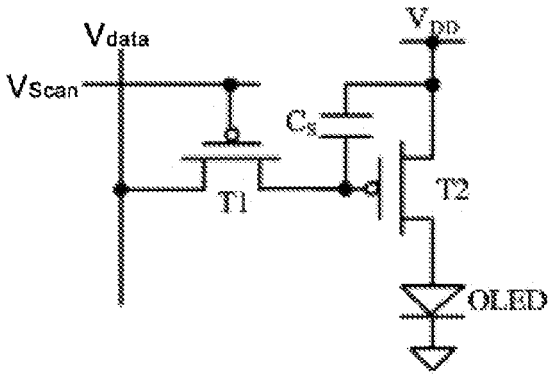
FIG. 1 is a schematic view showing a pixel circuit in the related art.
Figure 2:
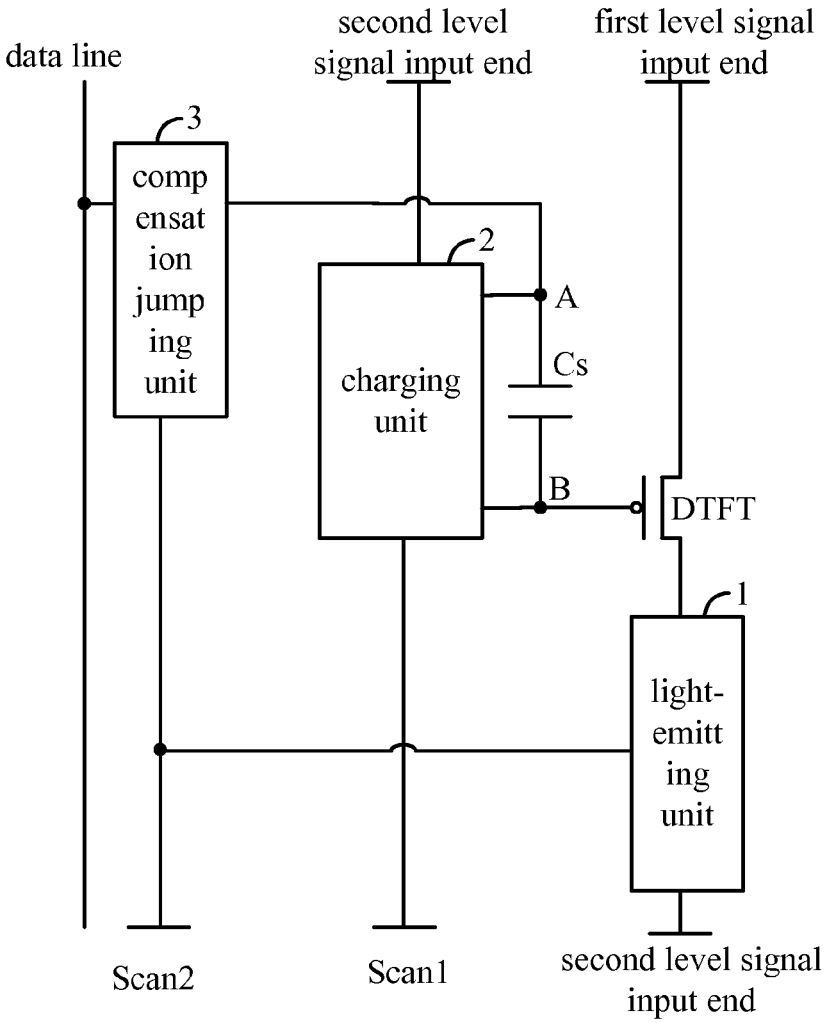
FIG. 2 is a schematic view showing a pixel circuit according to one embodiment of the present disclosure.

As shown in FIG. 2, the present disclosure provides in one embodiment a pixel circuit, including a storage capacitor Cs, a driving thin film transistor DTFT, and a light-emitting unit 1. A source electrode of the DTFT is connected to a first level signal input end, a gate electrode of the DTFT is connected to a second end of the storage capacitor Cs, and a drain electrode of the DTFT is connected to the light-emitting unit 1.

The pixel circuit further includes:

a charging unit 2 configured to, at a charging stage, control a first end of the storage capacitor Cs to be at a potential of an input signal from a second level signal input end, control the second end of the storage capacitor Cs to be at a potential equal to a difference between a potential of an input signal from the first level signal input end and a threshold voltage $V_{th}$ of the DTFT; and a compensation jumping unit 3 configured to, at a compensation jumping stage subsequent to the charging stage, control the first end of the storage capacitor Cs to be at a data voltage $V_{data}$, and enable a voltage at the second end of the storage capacitor Cs to jump to a sum of the data voltage and a difference between the potential of the input signal from the first level signal input end and the threshold voltage $V_{th}$ of the DTFT, so as to, at a light-emitting stage subsequent to the compensation jumping stage, enable the light-emitting unit 1 to emit light using the data voltage $V_{data}$.

According to the pixel circuit in the embodiment of the present disclosure, a driving current $I_{OLED}$ for the OLED is prevented from being adversely affected by the threshold voltage $V_{th}$ of the DTFT. As a result, it is able to provide the uniform driving current for the OLEDs in different pixel units of an OLED display panel, thereby to improve the display brightness evenness of the OLED display panel as well as an image display effect of a display device.

In one embodiment of the present disclosure, the input signal from the first level signal input end may be a high level signal, e.g., $V_{dd}$.

The input signal from the second level signal input end may be a low level signal, or it may be grounded so that a zero level signal is inputted from the second level signal input end. Hence, after the charging stage, the potential at the second end of the storage capacitor Cs is $V_{dd}-V_{th}$, and at the compensation jumping stage, this potential is $V_{dd}-V_{th}+V_{data}$.

In one embodiment, as shown in FIG. 2, the charging unit 2 may be connected to the second level signal input end, a first scanning signal input end (Scan1), the drain electrode of the DTFT, and the first end (node A) and the second end (Node B) of the storage capacitor Cs, respectively.

Figure 3:
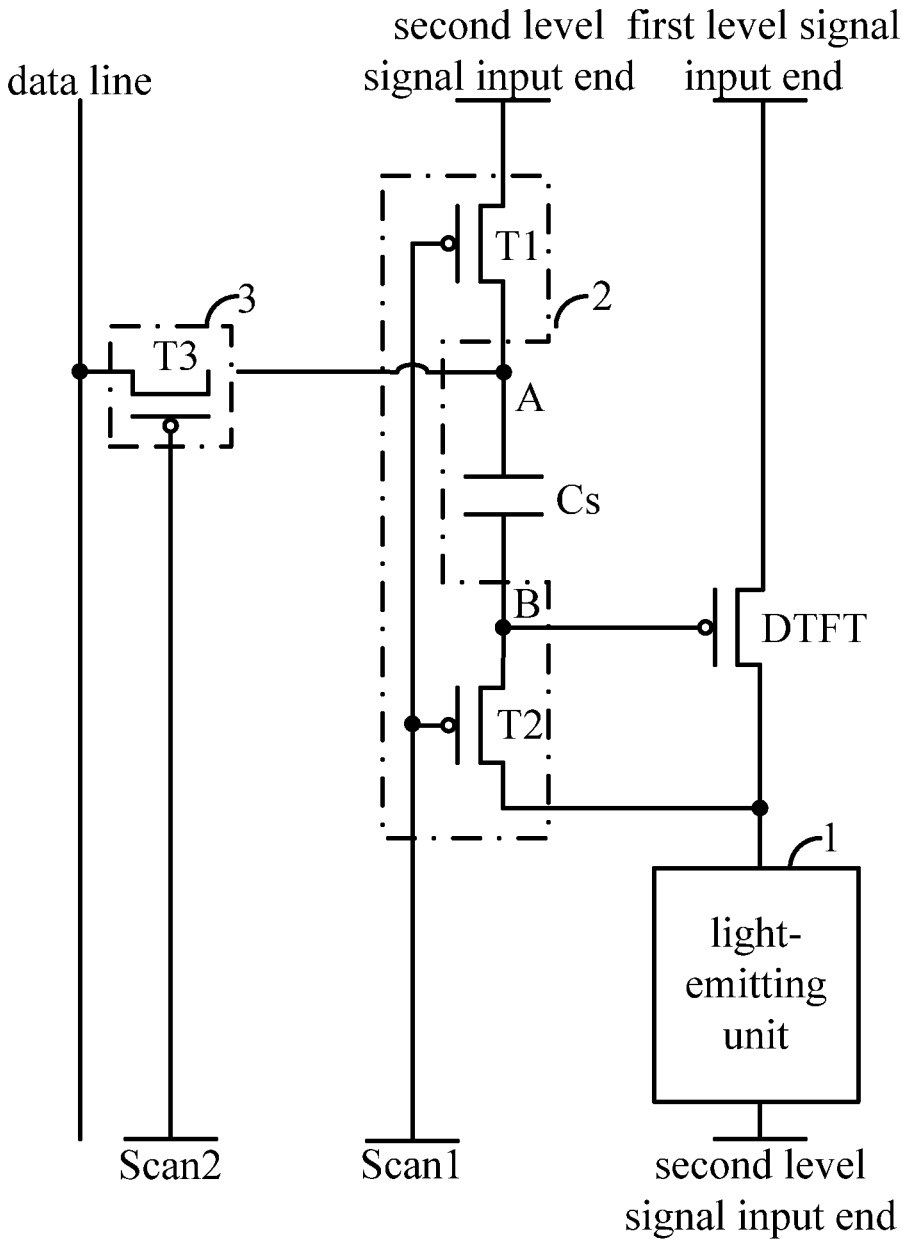
FIG. 3 is another schematic view showing the pixel circuit according to one embodiment of the present disclosure.

In an alternative embodiment, as shown in FIG. 3, the charging unit 2 may include a first TFT T1 and a second TFT T2. A source electrode of the first TFT T1 is connected to the second level signal input end, a gate electrode thereof is connected to the first scanning signal input end (Scan1), and a drain electrode thereof is connected to the first end of the storage capacitor Cs.

A source electrode of the second TFT T2 is connected to the drain electrode of the DTFT, a gate electrode thereof is connected to the first scanning signal input end (Scan1), and a drain electrode thereof is connected to the second end of the storage capacitor Cs.

At the charging stage, the first TFT T1 and the second TFT T2 are in an on state under the control of the first scanning signal $V_{scan1}$ from the first scanning signal input end. At this time, the input signal from the second level signal input end is transmitted via the first TFT T1 to the first end (node A) of the storage capacitor Cs, so that the potential at node A is equal to the potential of the input signal from the second level signal input end, e.g., zero. The input signal from the first level signal input end, e.g., $V_{dd}$, is transmitted via the second TFT T2 to the second end (node B) of the storage capacitor Cs (at the charging stage, the DTFT is in the on stage), so as to charge node B to $V_{dd}-V_{th}$. At this time, the potential at node A may be zero, so a voltage difference between nodes A and B of the storage capacitor Cs is $V_{dd}-V_{th}$.

In one embodiment, as shown in FIG. 2, the compensation jumping unit 3 is connected to a data line, a second scanning signal input end (Scan2) and the first end of the storage capacitor Cs.

In an alternative embodiment, as shown in FIG. 3, the compensation jumping unit 3 may include a third TFT T3, a source electrode of which is connected to the data line, a gate electrode of which is connected to the second scanning signal input end (Scan2), and a drain electrode of which is connected to the first end of the storage capacitor Cs.

At the compensation jumping stage, the third TFT T3 is in the on stage under the control of a second scanning signal $V_{scan2}$ from the second scanning signal input end, so as to transmit a signal from the data line to the first end of the storage capacitor Cs. The potential at the first end of the storage capacitor Cs is the potential of the input signal from the second level signal input end, e.g., zero, so the potential at the first end of the storage capacitor Cs jumps from 0 to $V_{data}$.

At the compensation jumping stage, the second end (node B) of the storage capacitor Cs is in a floating state, so when it is required to maintain the original voltage difference $V_{dd}-V_{th}$ between nodes A and B of the storage capacitor Cs, equal-voltage jumping occurs for the potential at node B in the case that the potential at node A is $V_{data}$, i.e., the potential at node B jumps to, and is maintained at, $V_{dd}-V_{th}+V_{data}$ for the subsequent light-emitting stage.

In an alternative embodiment, in order to ensure that at the charging stage the potential at the second end (node B) of the storage capacitor Cs is equal to a difference between the potential of the input signal $V_{dd}$ from the first level signal input end and the threshold voltage $V_{th}$ of the DTFT, the second end of the storage capacitor Cs may be discharged and reset at a resetting stage prior to the charging stage.

Figure 4:
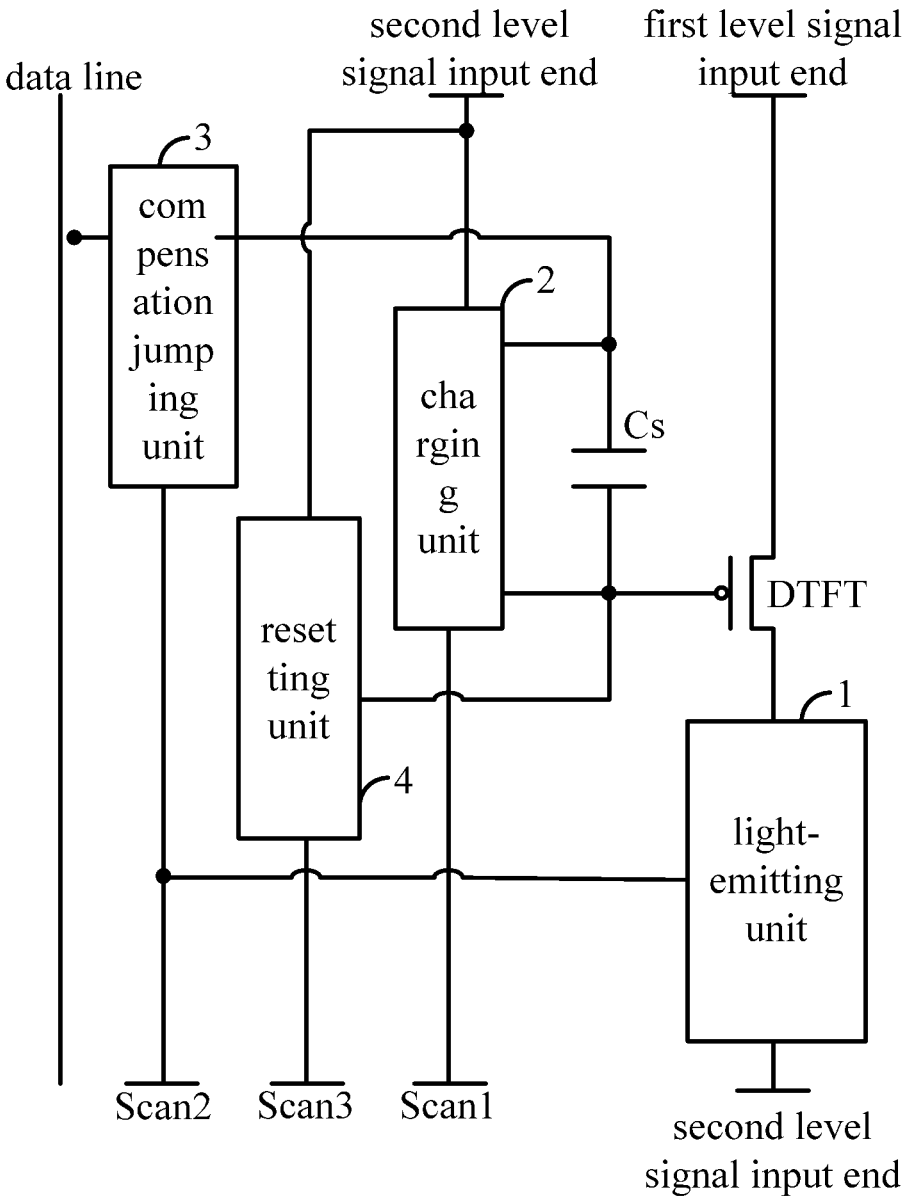
FIG. 4 is yet another schematic view showing the pixel circuit according to one embodiment of the present disclosure.

Hence, as shown in FIG. 4, the pixel circuit in the embodiment of the present disclosure may further include a resetting unit 4 configured to, at the resetting stage prior to the charging stage, control the second end of the storage capacitor Cs to be at the potential of the input signal from the second level signal input end.

To be specific, as shown in FIG. 4, the resetting unit 4 is connected to the second level signal input end, a third scanning signal input end (Scan3), and the second end of the storage capacitor Cs.

Figure 5:
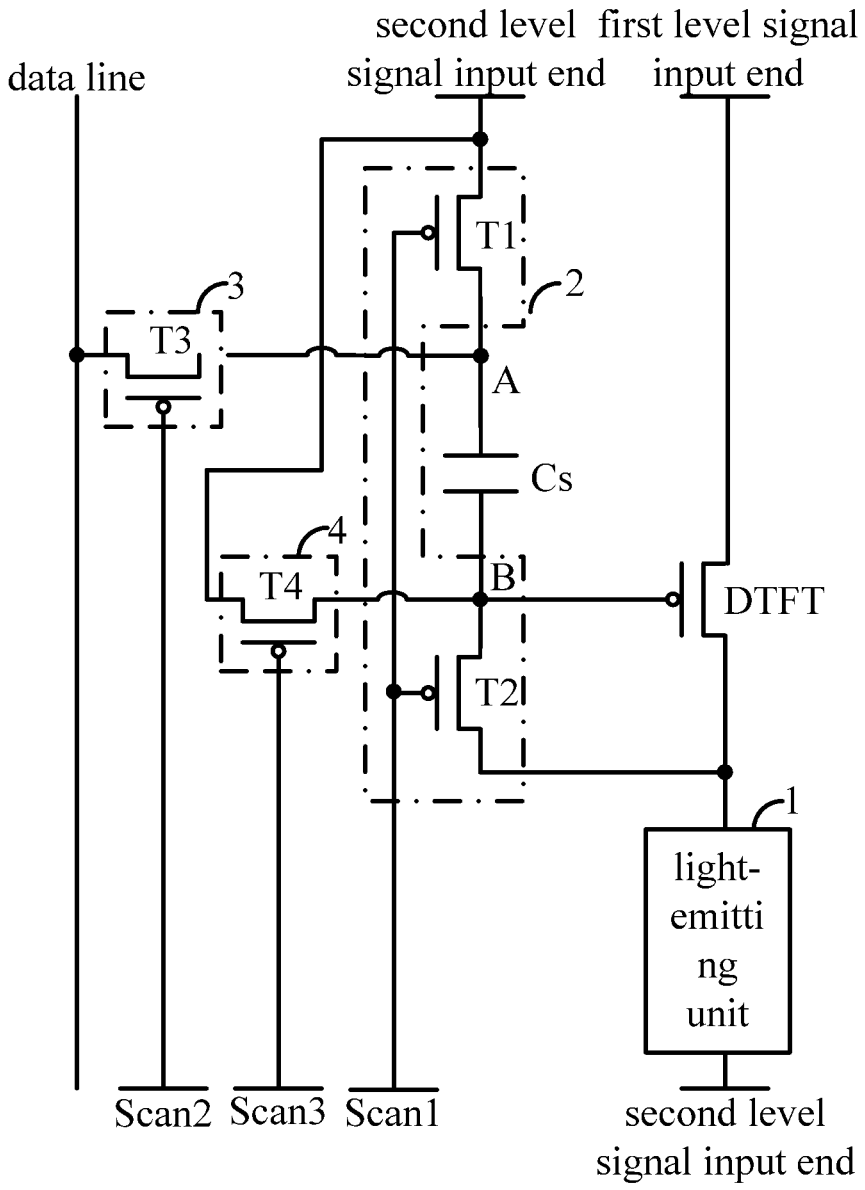
FIG. 5 is still yet another schematic view showing the pixel circuit according to one embodiment of the present disclosure.

In an alternative embodiment, as shown in FIG. 5, the resetting unit 4 may include a fourth TFT T4, a source electrode of which is connected to the second level signal input end, a gate electrode of which is connected to the third scanning signal input end Scan3, and a drain electrode of which is connected to the second end of the storage capacitor Cs.

The potential of the input signal from the second level signal input end may be zero, so the potential at the second end of the storage capacitor Cs may be reset to zero at the resetting stage.

In addition, when the potential at the second end of the storage capacitor Cs is reset to zero, it is able to maintain the DTFT in the on state, thereby to transmit the input signal (e.g., $V_{dd}$) from the first level signal input end to the charging unit 2 (specifically the source electrode of the second TFT T2) via the DTFT at the charging state, thereby to charge the second end of the storage capacitor Cs by the charging unit 2 to $V_{dd}-V_{th}$ at the charging stage using the input signal (e.g., $V_{dd}$) from the first level signal input end.

Figure 6:
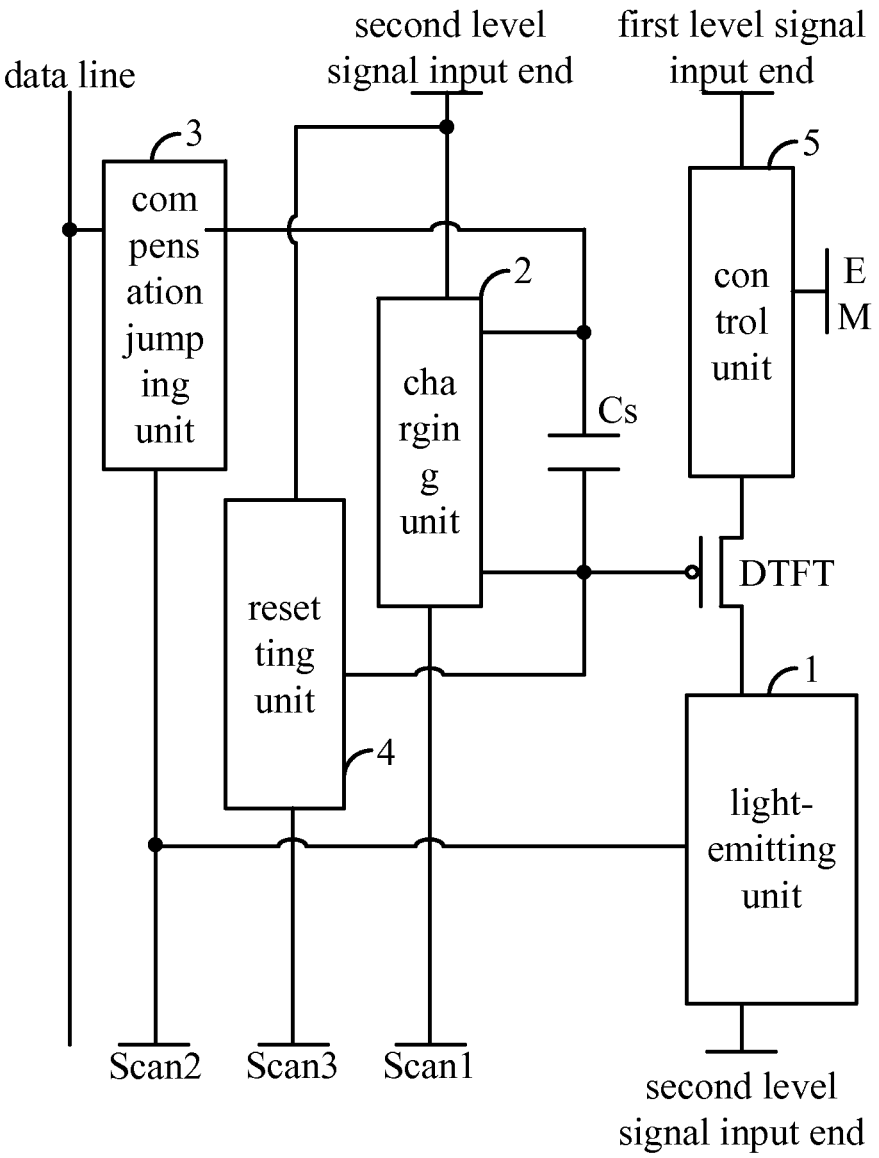
FIG. 6 is still yet another schematic view showing the pixel circuit according to one embodiment of the present disclosure.

In one embodiment, in order to control the input signal from the first level signal input end, as shown in FIG. 6, the pixel circuit may further include a control unit 5 configured to transmit, at the charging stage, the input signal from the first level signal input end to the DTFT so that the input signal is transmitted to the charging unit via the DTFT, and transmit, at the light-emitting stage, the input signal from the first level signal input end to the DTFT so that the signal is transmitted to the light-emitting unit 1 via the DTFT.

To be specific, as shown in FIG. 6, the control unit 5 may be connected to the first level signal input end, the control signal input end EM and the DTFT.

Figure 7:
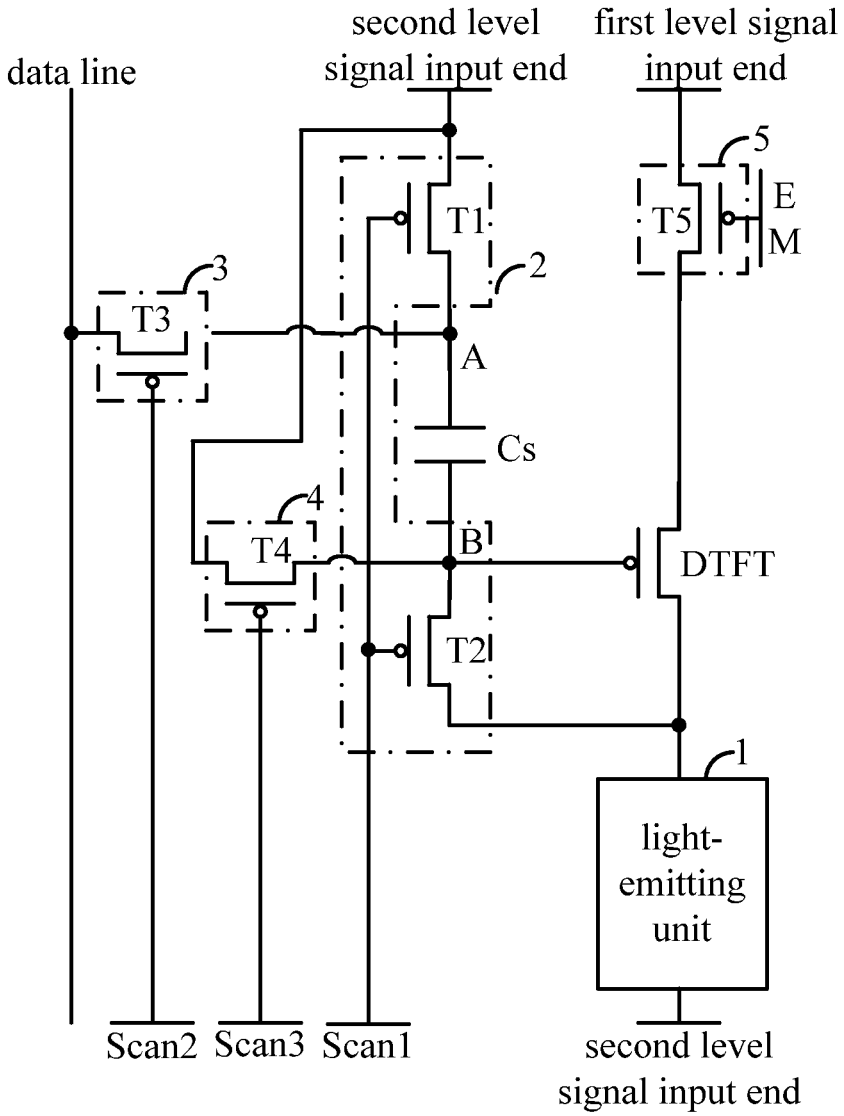
FIG. 7 is still yet another schematic view showing the pixel circuit according to one embodiment of the present disclosure.

In an alternative embodiment, as shown in FIG. 7, the control unit may include a fifth TFT T5, a source electrode of which is connected to the first level signal input end, a gate electrode of which is connected to the control signal input end EM, and a drain electrode of which is connected to the source electrode of the DTFT.

It should be appreciated that, in the embodiments of the present disclosure, the control unit 5 may be optional. In some other embodiments, an input sequence of the second level signal may be controlled, so as to achieve the function of the control unit 5.

Figure 8:
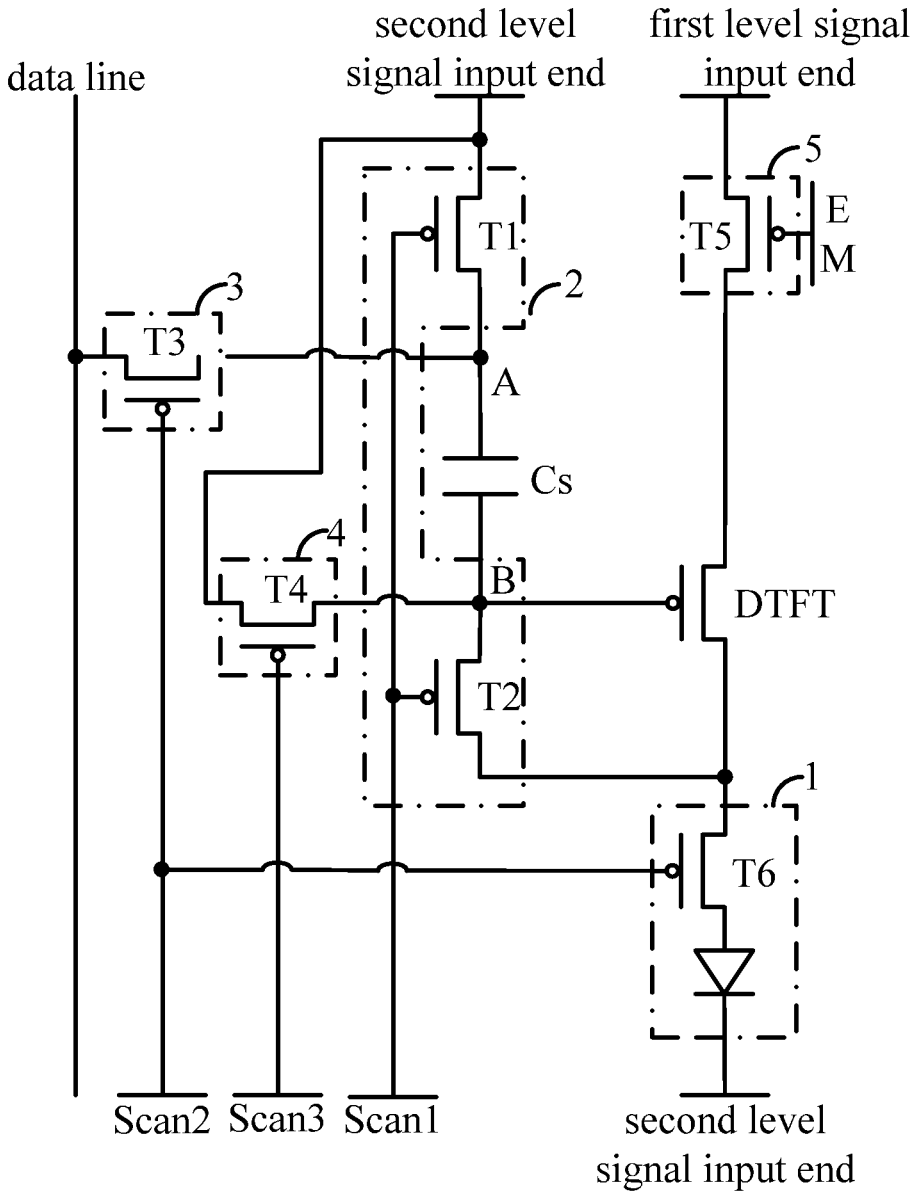
FIG. 8 is still yet another schematic view showing the pixel circuit according to one embodiment of the present disclosure.

In one embodiment, as shown in FIG. 8, the light-emitting unit 1 may include a sixth TFT T6, and an OLED. A source electrode of the sixth TFT T6 is connected to the drain electrode of the DTFT, a gate electrode thereof is connected to the second scanning signal input end (Scan2), and a drain electrode thereof is connected to an anode of the OLED. A cathode of the OLED is connected to the second level signal input end.

At the light-emitting stage, the control unit and the sixth TFT are both in the on stage, so the input signal (e.g., $V_{dd}$) from the first level signal input end may be transmitted to the source electrode of the DTFT, so a gate-to-source voltage $V_{GS}$ of the DTFT is equal to $V_{dd}-(V_{dd}-V_{th}+V_{data})$.

The current $I_{OLED}$ flowing through the OLED may be calculated by the equation:

$$\begin{aligned} I_{OLED} &= K(V_{GS}-V_{th})^2 \\ &= K[V_{dd}-(V_{dd}-V_{th}+V_{data})-V_{th}]^2 \\ &= K(V_{data})^2, \end{aligned}$$

wherein $V_{GS}$ is the gate-to-source voltage of the DTFT, and K is a constant related to a manufacturing process and a driver design of the DTFT.

As can be seen from the above equation, the driving current of the OLED depends merely on the data voltage $V_{data}$, regardless of the threshold voltage $V_{th}$ of the DTFT. Hence, it is able for the pixel circuit in the embodiments of the present disclosure to eliminate an effect caused by the threshold voltage of the DTFT on the light-emitting driving current, thereby to improve the display brightness evenness of the OLED display panel as well as the image display effect of the display device.

In an alternative embodiment, the TFTs (including T1-T6 and the DTFT) may be P-type transistors, and the source and drain electrodes of each transistor may be replaced with each other.

The data voltage in the embodiments of the present disclosure may be a negative voltage so as to ensure that $V_{dd}-V_{th}+V_{data}$ is of a negative value, thereby to enable the P-type DTFT to be in the on state at the light-emitting stage. In this way, the driving current $I_{OLED}$ for the OLED flows through the DTFT to the OLED, so as to enable the OLED to emit light.

Figure 9:
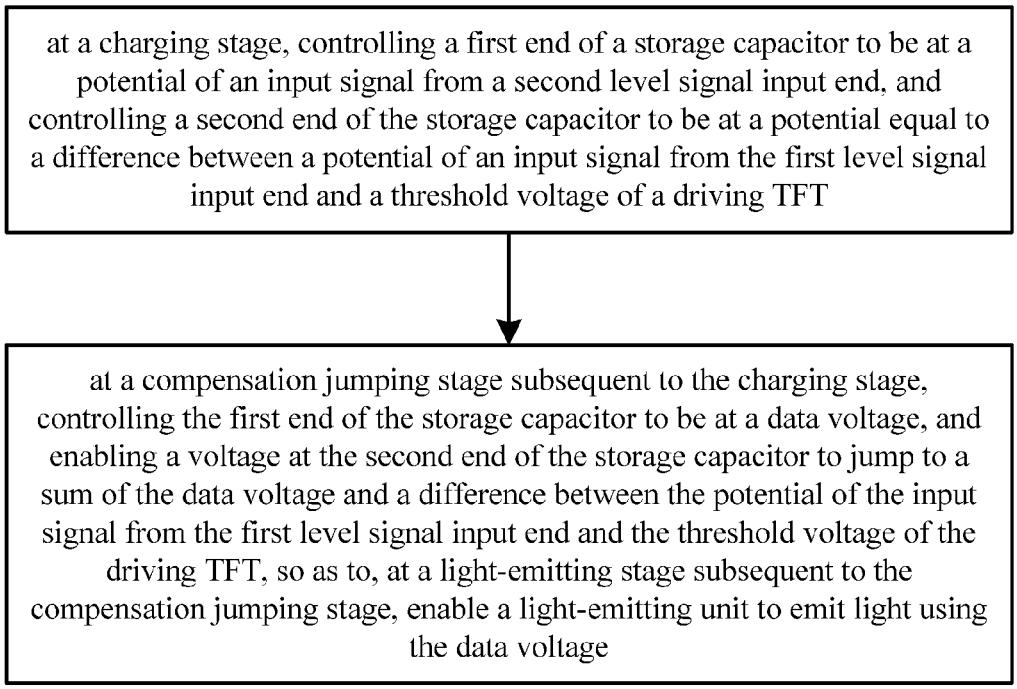
FIG. 9 is a flow chart of a method for driving a pixel circuit according to one embodiment of the present disclosure.

The present disclosure further provides in one embodiment a method for driving the above-mentioned pixel circuit. As shown in FIG. 9, the method may include steps of:

at the charging stage, controlling the first end of the storage capacitor Cs to be at the potential of the input signal from the second level signal input end, and controlling the second end of the storage capacitor Cs to be at the potential equal to a difference between the potential of the input signal from the first level signal input end and the threshold voltage $V_{th}$ of the DTFT; and at the compensation jumping stage subsequent to the charging stage, controlling the first end of the storage capacitor to be at the data voltage $V_{data}$, and enabling the voltage at the second end of the storage capacitor to jump to a sum of the data voltage and a difference between the potential of the input signal from the first level signal input end and the threshold voltage $V_{th}$ of the DTFT, so as to, at the light-emitting stage subsequent to the compensation jumping stage, enable the light-emitting unit to 1 emit light using the data voltage $V_{data}$.

According to the method in the embodiment of the present disclosure, it is able to eliminate an effect caused by the threshold voltage $V_{th}$ of the DTFT on the driving current $I_{OLED}$ for the OLED, thereby to provide the uniform driving current for the OLED in different pixel units of the OLED display panel, and improve the display brightness evenness of the OLED display panel as well as the image display effect of the display device.

In one embodiment of the present disclosure, the input signal from the first level signal input end may be a high level signal, e.g., $V_{dd}$. The input signal from the second level signal input end may be a low level signal, or it may be grounded so that a zero level signal is inputted from the second level signal input end. Hence, after the charging stage, the potential at the second end of the storage capacitor Cs is $V_{dd}-V_{th}$, and at the compensation jumping stage, this potential is $V_{dd}-V_{th}+V_{data}$.

In an alternative embodiment, the method may further include, at the resetting stage prior to the charging stage, controlling the second end of the storage capacitor Cs to be at the potential of the input signal from the second level signal input end.

In an alternative embodiment, at the charging stage, the method may further include transmitting the input signal from the first level signal input end to the DTFT, so that the input signal is transmitted to the second end of the storage capacitor Cs via the DTFT.

In an alternative embodiment, at the light-emitting stage, the method may further include transmitting the input signal from the first level signal input end to the DTFT, so that the input signal is transmitted to the light-emitting unit 1 via the DTFT.

An implementation procedure of the method for driving the pixel circuit will be described hereinafter.

Figure 10:
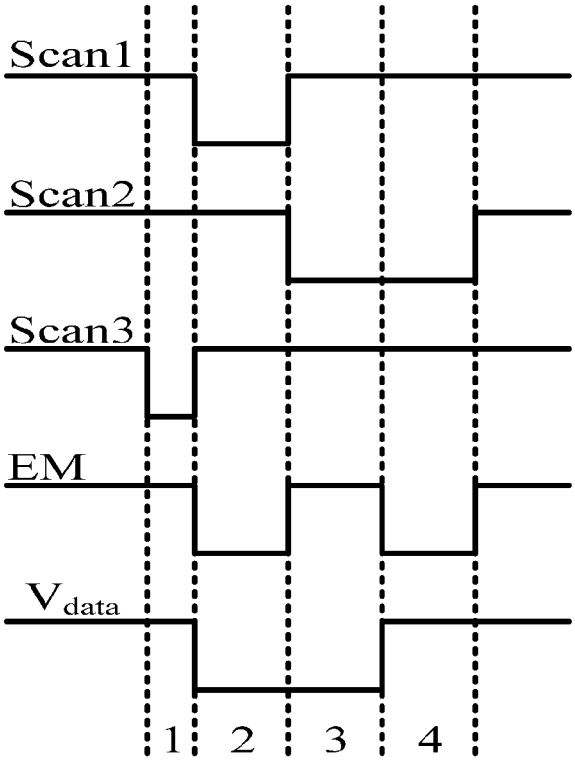
FIG. 10 is a sequence diagram of signals according to one embodiment of the present disclosure.

In one embodiment, the method may be applied to the pixel circuit in FIG. 8, where all the TFTs are P-type TFTs, the signal $V_{dd}$ is inputted from the first level signal input end, and the second level signal input end is grounded. FIG. 10 is a sequence diagram of the input signals.

Figure 11:
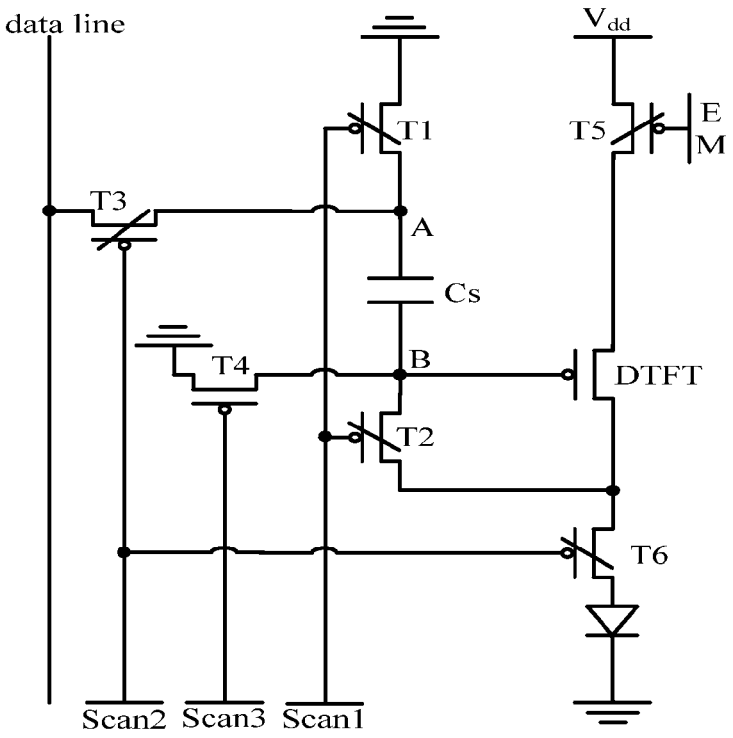
FIG. 11 is a schematic view showing a state of the pixel circuit according to one embodiment of the present disclosure.

At the resetting stage (stage 1 in FIG. 10), a low level signal is inputted from the third scanning signal input end (Scan3), the resetting unit 4 is in the on state (i.e., the fourth TFT T4 is in the on state), a high level signal is inputted from the first scanning signal input end (Scan1), the second scanning signal input end (Scan2) and the control signal input end EM, and the light-emitting unit 1, the charging unit 2, the compensation jumping unit 3 and the control unit 5 are in the off state (i.e., the first TFT T1, the second TFT T2, the third TFT T3, the fifth TFT T5 and the sixth TFT T6 are in the off state). FIG. 11 is a schematic view showing the state of the pixel circuit at this stage.

Because the resetting stage, the fourth TFT T4 is turned on, the second end (node B) of the storage capacitor Cs is reset and grounded, i.e., the potential at node B is 0V, so as to reset the original voltage signal at node B.

Figure 12:
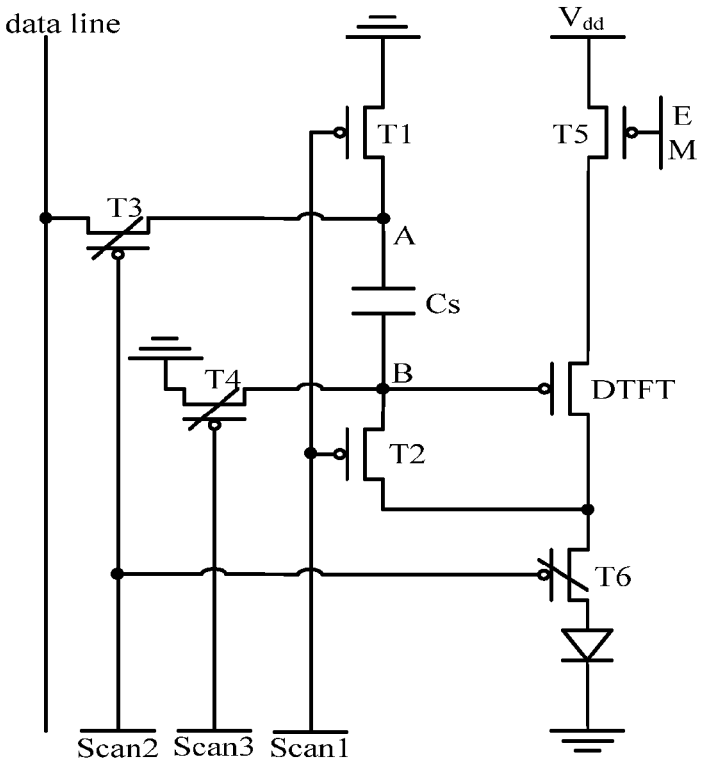
FIG. 12 is another schematic view showing the state of the pixel circuit according to one embodiment of the present disclosure.

At the charging stage (stage 2 in FIG. 10), a low level signal is inputted from the control signal input end EM and the first scanning signal input end (Scan1), the control unit 5 and the charging unit 2 are in the on state (i.e., the first TFT T1, the second TFT T2 and the fifth TFT T5 are in the on state), a high level signal is inputted from the second scanning signal input end (Scan2) and the third scanning signal input end (Scan3), and the resetting unit 4, the compensation jumping unit 3 and the light-emitting unit 1 are in the off state (i.e., the third TFT T3, the fourth TFT T4 and the sixth TFT T6 are in the off state). FIG. 12 is a schematic view showing the state of the pixel circuit at this stage.

Because node B has been grounded at the resetting stage, the DTFT is in the on state at the charging state. At this time, $V_{dd}$ is transmitted sequentially through the fifth TFT T5, the DTFT and the second TFT T2, so as to charge node B until the potential at node B reaches $V_{dd}-V_{th}$ (so as to enable a voltage difference between the source electrode and the gate electrode of the DTFT to be $V_{th}$). During the charging procedure, the potential at node A is always zero, so after the charging, the potential at node B is maintained at $V_{dd}-V_{th}$. In addition, the sixth TFT T6 is always in the off state at the charging stage, so the current does not flow through the OLED. As a result, it is able to prolong a service life of the OLED.

Figure 13:
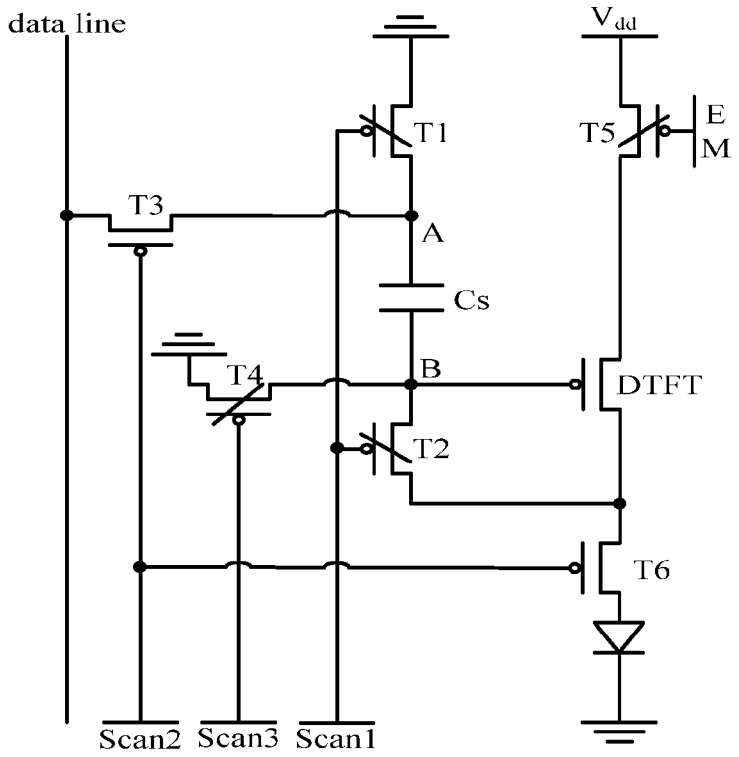
FIG. 13 is yet another schematic view showing the state of the pixel circuit according to one embodiment of the present disclosure.

At the compensation jumping stage (stage 3 in FIG. 10), a low level signal is inputted from the second scanning signal input end (Scan2), the compensation jumping unit 3 and the light-emitting unit 1 are in the on state (i.e., the third TFT T3 and the sixth TFT T6 are in the on state), a high level signal is inputted from the first scanning signal input end (Scan1), the third scanning signal input end (Scan3) and the control signal input end EM, and the resetting unit 4, the charging unit 2 and the control unit 5 are in the off state (i.e., the first TFT T1, the second TFT T2, the fourth TFT T4 and the fifth TFT T5 are in the off state). FIG. 13 is a schematic view showing the state of the pixel circuit at this stage.

Because the third TFT T3 is in the on state at the compensation jumping stage, so the potential at node A jumps from zero to $V_{data}$. At this time, node B is in a floating state. When it is required to maintain the original voltage difference $V_{dd}-V_{th}$ between nodes A and B of the storage capacitor Cs, equal-voltage jumping occurs for the potential at node B in the case that the potential at node A is $V_{data}$, i.e., the potential at node B jumps to, and is maintained at, $V_{dd}-V_{th}+V_{data}$ for the subsequent light-emitting stage.

Figure 14:
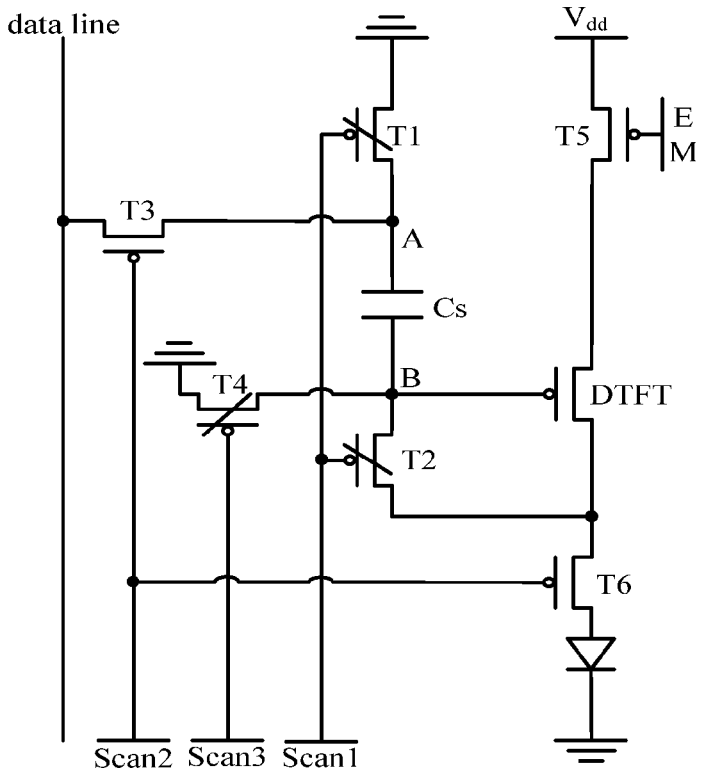
FIG. 14 is still yet another schematic view showing the state of the pixel circuit according to one embodiment of the present disclosure.

At the light-emitting stage (stage 4 in FIG. 10), a low level signal is inputted from the second scanning signal input end (Scan2) and the control signal input end EM, the control unit 5, the compensation jumping unit 3 and the light-emitting unit 1 are in the on state (i.e., the third TFT T3, the fifth TFT T5 and the sixth TFT T6 are in the on state), a high level signal is inputted from the first scanning signal input end (Scan1) and the third scanning signal input end (Scan3), and the resetting unit 4 and the charging unit 2 are in the off state (i.e., the first TFT T1, the second TFT T2 and the fourth TFT T4 are in the off state). FIG. 14 is a schematic view showing the state of the pixel circuit at this stage.

Because the fifth TFT T5 is in the on state at the light-emitting stage, the potential at the source electrode of the DTFT is $V_{dd}$, and the current sequentially flows through the fifth TFT T5, the DTFT and the sixth TFT T6, so as to enable the OLED to emit light.

The driving current $I_{OLED}$ for the DTFT may be calculated by the equation:

$$I_{OLED} = K(V_{GS} - V_{th})^2$$
$$= K[V_{dd} - (V_{dd} - V_{th} + V_{data}) - V_{th}]^2$$
$$= K(V_{data})^2,$$

wherein $V_{GS}$ represents the gate-to-source voltage of the DTFT, and K is a constant related to a manufacturing process and a driver design of the DTFT.

As can be seen from the above equation, the driving current $I_{OLED}$ merely depends on the data voltage $V_{data}$, regardless of the threshold voltage $V_{th}$ of the DTFT. As a result, it is able to completely prevent the threshold voltage drift of the DTFT due to a manufacturing process and a long-term operation, eliminate an effect caused by the threshold voltage $V_{th}$ of the DTFT on $I_{OLED}$, and ensure a normal operation of the OLEDs in different pixel units, thereby to improve the display brightness evenness of the OLED display panel as well as the image display effect of the display device.

In addition, as shown in FIG. 10, the data voltage $V_{data}$ is a negative voltage at the charging stage and the compensation jumping stage, and a positive voltage at the resetting stage and the light-emitting stage.

The present disclosure further provides in one embodiment an OLED display panel including the above-mentioned pixel circuit.

The present disclosure further provides in one embodiment a display device including the above-mentioned OLED display panel.

The display device may be a liquid crystal panel, a liquid crystal TV, a liquid crystal display, an OLED panel, and OLED display, a plasma display or an electronic paper.

The pixel circuit, the OLED display panel and the display device in the embodiments of the present disclosure are particularly applicable to a GOA circuit manufactured by a low temperature polysilicon (LTPS) technology. Of course, it may also be applicable to the GOA circuit manufactured by an a-Si technology.

According to the pixel circuit, its driving method, the OLED display panel and the display device in the embodiments of the present disclosure, the pixel circuit includes the charging unit configured to, at a charging stage, control the first end of the storage capacitor to be at the potential of the input signal from the second level signal input end, control the second end of the storage capacitor to be at the potential equal to a difference between the potential of the input signal from the first level signal input end and the threshold voltage of the driving TFT; and the compensation jumping unit configured to, at the compensation jumping stage subsequent to the charging stage, control the first end of the storage capacitor to be at the data voltage, and enable the voltage at the second end of the storage capacitor to jump to a sum of the data voltage and a difference between the potential of the input signal from the first level signal input end and the threshold voltage of the driving TFT, so as to, at the light-emitting stage subsequent to the compensation jumping stage, enable the light-emitting unit to emit light using the data voltage. As a result, it is able to eliminate an effect caused by the threshold voltage of the driving TFT on a light-emitting driving current, thereby to improve the display brightness evenness of the OLED display panel as well as an image display effect of the display device.

In addition, according to the embodiments of the present disclosure, it is able to prevent the current from passing through the OLED for a long period of time, thereby to prolong the service life of the OLED.

It should be appreciated that, the pixel circuit in the embodiments of the present disclosure may be applicable to the thin film transistors manufactured by a-Si, poly-Si or oxide. In addition, although the description is given hereinabove by taking the P-type thin film transistor as an example, the N-type thin film transistors or CMOS transistors may also be used. Further, although the AMOLED is mentioned in the above embodiments, the present disclosure is not limited thereto, and it may also be applicable to the other LED display devices.

The above are merely the preferred embodiments of the present disclosure. It should be appreciated that, a person skilled in the art may make further modifications and improvements without departing from the principle of the present disclosure, and these modifications and improvements shall also fall within the scope of the present disclosure.

What is claimed is:

1. A pixel circuit, comprising a storage capacitor, a driving thin film transistor (TFT) and a light-emitting device, a source electrode of the driving TFT being connected to a first level signal input end, a gate electrode of the driving TFT being connected to a second end of the storage capacitor, and a drain electrode of the driving TFT being connected to the light-emitting device, the pixel circuit further comprising:

a charging circuit configured to, at a charging stage, control a first end of the storage capacitor to be at a potential of an input signal from a second level signal input end, control the second end of the storage capacitor to be at a potential equal to a difference between a potential of an input signal from the first level signal input end and a threshold voltage of the driving TFT;

a compensation jumping circuit configured to, at a compensation jumping stage subsequent to the charging stage, control the first end of the storage capacitor to be at a data voltage, and enable a voltage at the second end of the storage capacitor to transition to a sum of the data voltage and the difference between the potential of the input signal from the first level signal input end and the threshold voltage of the driving TFT, so as to, at a light-emitting stage subsequent to the compensation jumping stage, enable the light-emitting device to emit light using the data voltage; and a resetting circuit configured to, at a resetting stage prior to the charging stage, control the second end of the storage, capacitor to be at a potential of an input signal from the second level signal input end, wherein the resetting circuit is connected to the second level signal input end, a third scanning signal input end and the second end of the storage capacitor, respectively.

2. The pixel circuit according to claim 1, wherein the charging circuit is connected to the second level signal input end, a first scanning signal input end, the drain electrode of the driving TFT, the first end and the second end of the storage capacitor, respectively.

3. The pixel circuit according to claim 2, wherein the charging circuit comprises a first TFT and a second TFT;

a source electrode of the first TFT is connected to the second level signal input end, a gate electrode of the first TFT is connected to the first scanning signal input end, and a drain electrode of the first TFT is connected to the first end of the storage capacitor; and a source electrode of the second TFT is connected to the drain electrode of the driving TFT, a gate electrode of the second TFT is connected to the first scanning signal input end, and a drain electrode of the second TFT is connected to the second end of the storage capacitor.

4. The pixel circuit according to claim 1, wherein the compensation jumping circuit is connected to a data line, a second scanning signal input end and the first end of the storage capacitor, respectively.

5. The pixel circuit according to claim 4, wherein the compensation jumping circuit comprises:

a third TFT having a source electrode connected to the data line, a gate electrode connected to the second scanning signal input end and a drain electrode connected to the first end of the storage capacitor.

6. The pixel circuit according to claim 1, wherein the resetting circuit comprises:

a fourth TFT having a source electrode connected to the second level signal input end, a gate electrode connected to the third scanning signal input end and a drain electrode connected to the second end of the storage capacitor.

7. The pixel circuit according to claim 1, further comprising:

a control circuit configured to transmit, at the charging stage, the input signal from the first level signal input end to the driving TFT so that the input signal is transmitted to the charging circuit via the driving TFT, and transmit, at the light-emitting stage, the input signal from the first level signal input end to the driving TFT so that the signal is transmitted to the light-emitting device via the driving TFT; and wherein the control circuit is connected to the first level signal input end, a control signal input end and the driving TFT, respectively.

8. The pixel circuit according to claim 7, wherein the control circuit comprises:

a fifth TFT having a source electrode connected to the first level signal input end, a gate electrode connected to the control signal input end and a drain electrode connected to the source electrode of the driving TFT.

9. The pixel circuit according to claim 1, wherein the light-emitting device comprises a sixth TFT and an organic light-emitting diode (OLED);

wherein a source electrode of the sixth TFT is connected to the drain electrode of the driving TFT, a gate electrode of the sixth TFT is connected to a second scanning signal input end, and a drain electrode of the sixth TFT is connected to an anode of the OLED; and a cathode of the OLED is connected to the second level signal input end.

10. The pixel circuit according to claim 1, wherein the TFTs are P-type TFTs, the input signal from the first level signal input end is a high level signal, and the input signal from the second level signal input end is a low level signal.

11. A method for driving the pixel circuit according to claim 1, comprising:

at a charging stage, controlling a first end of a storage capacitor to be at a potential of an input signal from a second level signal input end, and controlling a second end of the storage capacitor to be at a potential equal to a difference between a potential of an input signal from the first level signal input end and a threshold voltage of a driving TFT; and at a compensation jumping stage subsequent to the charging stage, controlling the first end of the storage capacitor to be at a data voltage, and enabling a voltage at the second end of the storage capacitor to jump to a sum of the data voltage and the difference between the potential of the input signal from the first level signal input end and the threshold voltage of the driving TFT, so as to, at a light-emitting stage subsequent to the compensation jumping stage, enable a light-emitting device to emit light using the data voltage.

12. The method according to claim 11, further comprising:

at a resetting stage prior to the charging stage, controlling the second end of the storage capacitor to be at the potential of the input signal from the second level signal input end.

13. The method according to claim 12, wherein at the charging stage, the method further comprises:

transmitting the input signal from the first level signal input end to the driving TFT, so that the input signal is transmitted to the second end of the storage capacitor via the driving TFT; and at the light-emitting stage, the method further comprises:

transmitting the input signal from the first level signal input end to the driving TFT, so that the input signal is transmitted to the light-emitting device via the driving TFT.

14. The method according to claim 13, wherein at the resetting stage, a low level signal is inputted from a third scanning signal input end, a resetting circuit is in an on stage, a high level signal is inputted from each of first and second scanning signal input end and a control signal input end, and the charging circuit, the compensation jumping circuit, the light-emitting device and a control circuit are in an off state;

at the charging stage, a low level signal is inputted from the control signal input end and the first scanning signal input end, the controlling circuit and the charging circuit are both in the on state, a high level signal is inputted from the second and third scanning signal input end, and the resetting circuit, the compensation jumping circuit and the light-emitting device are in the off state;

at the compensation jumping stage, a low level signal is inputted from the second scanning signal input end, the compensation jumping circuit and the light-emitting circuit are in the on state, a high level signal is inputted from the first and third scanning signal input end and the control signal input end, and the resetting circuit, the charging circuit and the control circuit are in the off state; and at the light-emitting stage, a low level signal is inputted from the second scanning signal input end and the control signal input end, the control circuit, the compensation jumping circuit and the light-emitting device are in the on state, a high level signal is inputted from the first and third scanning signal input end, and the resetting circuit and the charging circuit are in the off state.

15. The method according to claim 14, wherein at the charging stage and the compensation jumping stage, a signal from a data line is at a negative voltage, and at the resetting stage and the light-emitting stage, the signal from the data line is at a positive voltage.

16. An organic light-emitting display panel comprising the pixel circuit according to claim 1.

17. A display device comprising the organic light-emitting display panel according to claim 16.

18. The organic light-emitting display panel according to claim 16, wherein the charging circuit is connected to the second level signal input end, a first scanning signal input end, the drain electrode of the driving TFT, the first end and the second end of the storage capacitor, respectively.

19. The organic light-emitting display panel according to claim 18, wherein the charging circuit comprises a first TFT and a second TFT;

a source electrode of the first TFT is connected to the second level signal input end, a gate electrode of the first TFT is connected to the first scanning signal input end, and a drain electrode of the first TFT is connected to the first end of the storage capacitor; and a source electrode of the second TFT is connected to the drain electrode of the driving TFT, a gate electrode of the second TFT is connected to the first scanning signal input end, and a drain electrode of the second TFT is connected to the second end of the storage capacitor.

* * * * *